US012643006B2

(12) United States Patent
Mclean

(10) Patent No.: US 12,643,006 B2
(45) Date of Patent: Jun. 2, 2026

(54) LEG EXERCISE APPARATUS

(71) Applicant: DADDYSGYM LTD, Dumfries (GB)

(72) Inventor: Scott Andrew Mclean, Dumfries (GB)

(73) Assignee: Daddysgym Ltd., Dumfries (GB)

( * ) Notice: Subject to any disclaimer, the term of this patent is extended or adjusted under 35 U.S.C. 154(b) by 241 days.

(21) Appl. No.: 18/568,651

(22) PCT Filed: Jun. 8, 2022

(86) PCT No.: PCT/GB2022/051438
§ 371 (c)(1),
(2) Date: Dec. 8, 2023

(87) PCT Pub. No.: WO2022/258968
PCT Pub. Date: Dec. 15, 2022

(65) Prior Publication Data

US 2024/0278065 A1 Aug. 22, 2024

(30) Foreign Application Priority Data

Jun. 9, 2021 (GB) ..... 2108200

(51) Int. Cl.
*A63B 21/00* (2006.01)
*A63B 21/072* (2006.01)

(52) U.S. Cl.
CPC ..... *A63B 21/4034* (2015.10); *A63B 21/072* (2013.01)

(58) Field of Classification Search
CPC ..... A63B 21/072; A63B 21/0724; A63B 21/0726; A63B 21/4013; A63B 21/4015; A63B 21/4034; A63B 21/4035; A63B 23/035; A63B 23/03508; A63B 23/03516; A63B 23/0355; A63B 23/04; A63B 2208/0204; A63B 2225/102
See application file for complete search history.

(56) References Cited

U.S. PATENT DOCUMENTS 2,114,790 A * 4/1938 Venables ..... A63B 21/4001 482/79
4,964,631 A * 10/1990 Marano ..... A63B 21/4013 482/93
6,196,950 B1 3/2001 Emick
(Continued)

OTHER PUBLICATIONS

International Search Report and Written Opinion issued in corresponding Application No. PCT/GB2022/051438 on Sep. 16, 2022; 12 pages.

(Continued)

*Primary Examiner* — Joshua Lee
(74) *Attorney, Agent, or Firm* — Calderon Safran & Wright P.C.; David S. Safran

(57) ABSTRACT

A leg exercise apparatus, the leg exercise apparatus comprising a frame member, the frame member including: at least one foot receiving portion; and at least one leg engagement portion wherein the at least one leg engagement portion is spaced from the at least one foot receiving portion such that, in use, when a user's foot is located on the at least one foot receiving portion, the at least one leg engagement portion may contact a portion of the user's leg. Also disclosed is a method of using the leg exercise apparatus.

18 Claims, 9 Drawing Sheets

(56) References Cited

U.S. PATENT DOCUMENTS

| | | | | |
|---|---|---|---|---|
| 6,485,399 | B2 * | 11/2002 | Greene | A63B 21/4015 482/106 |
| 6,592,497 | B2 * | 7/2003 | Greenheck | A63B 23/0494 482/79 |
| 10,881,895 | B2 * | 1/2021 | Gubera | A63B 23/04 |
| 2002/0119872 | A1 | 8/2002 | Greenheck | |
| 2008/0207414 | A1 | 8/2008 | Cook et al. | |
| 2018/0243603 | A1 | 8/2018 | Little | |

OTHER PUBLICATIONS

Search Report issued in related Patent Application No. GB2108200.3 on Sep. 20, 2021; 3 pages.

* cited by examiner

LEG EXERCISE APPARATUS

FIELD OF THE INVENTION

The present invention relates to a leg exercise apparatus and particularly, but not exclusively, to a leg exercise apparatus for exercising the hamstrings. The present invention also relates to a method of using the leg exercise apparatus.

BACKGROUND TO THE INVENTION

Exercise apparatus can be used to exercise any muscle in the body. Known exercise apparatus for exercising the hamstrings tend to be large or bulky items of equipment, such as exercise machines primarily designed for gym-use. Additionally, many known leg exercise apparatus require the user to partner with another person to safely use the apparatus.

Many forms of leg exercise apparatus are found only in the gym environment. In many cases this type of apparatus is not suitable for one to use in the home, or in a smaller environment. This type of leg exercise apparatus can also be costly to manufacture.

Therefore, there is a need to develop a leg exercise apparatus which can be used and stored in a small environment, such as in the home. There is also a need to develop a leg exercise apparatus that is safe to use unsupervised.

The inventor has appreciated the shortcomings in known leg exercise apparatus.

STATEMENTS OF INVENTION

According to a first aspect of the present invention there is provided a leg exercise apparatus, the leg exercise apparatus comprising a frame member, the frame member including:

at least one foot receiving portion; and at least one leg engagement portion;

wherein the at least one leg engagement portion is spaced from the at least one foot receiving portion such that, in use, when a user's foot is located on the at least one foot receiving portion, the at least one leg engagement portion may contact a portion of the user's leg.

The frame member may comprise a horizontal axis, a vertical axis, and a lateral axis. The horizontal, vertical and lateral axes may be orthogonal. A first plane of the frame member may be defined by the horizontal axis of the frame and the vertical axis of the frame. A second plane of the frame member may be defined by the horizontal axis and the lateral axis of the frame member.

The apparatus may be a free-standing apparatus. The apparatus may be a free-weight apparatus. The apparatus may be a barbell.

The apparatus may be free-standing when one or more base members or weights are added thereto.

The frame member may be formed from one or more support members. The frame member may comprise one or more support members. The one or more support members may be bars, rods, elongate members, weightlifting bars, or the like.

The frame member may be free-standing. The frame member may be a barbell. The frame member may be a weightlifting bar, or the like.

The frame member may comprise a first support member and a second support member spaced apart along at least one axis of the frame member. The first support member and the second support member may be spaced apart along two or more axes of the frame member. The first support member and the second support member of the frame member may be spaced apart along the vertical axis of the frame member. The first support member and the second support member of the frame member may be spaced apart along the lateral axis of the frame member. The first support member and the second support member of the frame member may be spaced apart along the horizontal axis of the frame member. The first support member and the second support member of the frame member may be spaced apart along the vertical axis of the frame member and spaced apart along the lateral axis of the frame member.

The first support member may be an elongate member. The first support member may be a cylindrical member. The first support member may be elongate in the direction of the horizontal and/or lateral axes of the frame member. The second support member may be an elongate member. The second support member may be elongate in the direction of the horizontal and/or lateral axes of the frame member. The second support member may be a cylindrical member. The first support member may be substantially parallel to the second support member. The first support member may be substantially parallel to the second support member along the horizontal axis of the frame.

The first support member may include the at least one leg engagement portion of the frame member. The at least one leg engagement portion of the frame member may be located on, or adjacent to, the first support member. The first support member may provide support to the at least one leg engagement portion.

The second support member may include the at least one foot receiving portion of the frame member. The at least one foot receiving portion of the frame member may be located on, or adjacent to, the second support member. The second support member may provide support to the at least one foot receiving portion.

The foot receiving portion may be configured to be expandable and/or retractable. The foot receiving portion may be movable between a first foot receiving arrangement and a second foot receiving arrangement. In the second foot receiving arrangement, the surface area of the foot receiving portion may be substantially greater than the second foot receiving arrangement. In the second foot receiving arrangement the length of the foot receiving portion may be substantially greater than in the first foot receiving arrangement. The foot receiving portion may comprise one or more expandable or retractable portions operable to transition the foot receiving portion between the first and second foot receiving arrangements. The expandable or retractable portions may be manually operable portions. The foot receiving portion may be lockable in the first foot receiving arrangement and/or in the second foot receiving arrangement.

At least a portion of the second support member may comprise a knurled portion. The knurled portion can comprise sharp, deep, coarse or dulled knurling. The knurled portion can comprise sharp and deep knurling.

At least a portion of the at least one foot receiving portion of the frame member may comprise a knurled portion. The knurled portion can comprise sharp, deep, coarse or dulled knurling. The knurled portion can comprise sharp and deep knurling.

The second support member may provide support to the at least one leg engagement portion. The second support member may provide support to the first support member.

The first support member may comprise a first end portion. The first support member may comprise a second end portion. The first support member may comprise a central portion. The central portion of the first support member may be arranged between the first end portion of the first support member and the second end portion of the first support member.

The first support member may comprise an x-axis. The x-axis of the first support member may be arranged along the horizontal axis of the frame member. The first support member may comprise a y-axis. The y-axis of the first support member may be arranged perpendicular to the x-axis of the first support member. The second support member may have an x-axis. The x-axis of the second support member may be arranged along the horizontal axis of the frame member. The second support member may have a y-axis. The y-axis of the second support member may be perpendicular to the x-axis of the second support member.

The first support member may be between 200 mm and 750 mm in length along the x-axis thereof. The first support member may be between 250 mm and 500 mm in length along the x-axis thereof. The first support member may be between 250 mm and 300 mm in length along the x-axis thereof.

The second support member may be between 200 mm to 750 mm in length along the x-axis thereof. The second support member may be between 250 mm to 500 mm in length along the x-axis thereof. The second support member may be between 250 mm to 300 mm in length along the x-axis thereof.

The first support member may be between 10 mm to 100 mm in width along the y-axis thereof. The first support member may be between 10 mm to 80 mm in width along the y-axis thereof. The first support member may be between 10 mm to 50 mm in width along the y-axis thereof.

The second support member may be between 10 mm to 100 mm in width along the y-axis thereof. The second support member may be between 10 mm to 80 mm in width along the y-axis thereof. The second support member may be between 10 mm to 50 mm in width along the y-axis thereof.

The first support member and the second support member may be substantially the same length. The first support member and the second support member may be different in length. The second support member may be shorter in length along the x-axis thereof than the length of first support member along the x-axis thereof. The first support member may be shorter in length along the x-axis thereof than the length of the second support member along the x-axis thereof.

The first support member and the second support member may be substantially the same width. The first support member and the second support member may be different in width. The second support member may be shorter in width along its y-axis than the width of first support member along its y-axis. The first support member may be shorter in width along its y-axis than the width of second support member along its y-axis.

The second support member may comprise a first end portion. The second support member may comprise a second end portion. The second support member may comprise a central portion. The central portion of the second support member may be between the first end portion of the second support member and the second end portion of the second support member.

The frame member may comprise a third support member. The third support member may be an elongate member. The third support member may be a cylindrical member. The third support member may be elongate in the direction of the vertical axis of the frame member. The first support member and the second support member may be connected by at least the third support member. The first support member and the second support member may be connected together only by the third support member. The third support member may be substantially perpendicular to the first support member. The third support member may be arranged along at least one axis of the frame member. The third support member may be arranged substantially along the vertical axis of the frame member. The third support member may be arranged along the vertical axis of the frame member and may be substantially perpendicular to the first support member, the first support member being arranged along the horizontal axis and/or lateral axis of the frame member.

The third support member may be perpendicular to the second support member. The third support member may be arranged along the vertical axis of the frame member and may be substantially perpendicular to the second support member, the second support member being arranged along the horizontal axis and/or lateral axis of the frame member.

The third support member may be perpendicular to the first support member and the second support member. The third support member may be arranged along the vertical axis of the frame member and may be substantially perpendicular to the first support member and the second support member, which may be arranged along the horizontal axis of the frame member.

The third support member may be connected to the central portion of the first support member. The third support member may be connected to the central portion of the second support member. The third support member may connect the central portion of the first support member and the central portion of the second support member.

The third support member may comprise a z-axis. The z-axis may be arranged substantially along the vertical axis of the frame member. The z-axis may be angularly offset with respect to the vertical axis of the frame member about the horizontal axis of the frame member. The z-axis may be angularly offset with respect to the vertical axis of the frame member about the horizontal axis of the frame member by an angle of between approximately 0 degrees and approximately 65 degrees, optionally between approximately 15 degrees and approximately 65 degrees, optionally between approximately 18 degrees and approximately 60 degrees.

The x-axis of the first support member may be angularly offset about the horizontal axis of the frame member. The x-axis of the first support member may be angularly offset about the horizontal axis of the frame member by an angle of between approximately 0 degrees and approximately 65 degrees, optionally between approximately 15 degrees and approximately 65 degrees, optionally between approximately 18 degrees and approximately 60 degrees. The x-axis of the first support member and the z-axis of the third support member may be orthogonal. The x-axis of the first support member may be angularly offset about the x-axis of the second support member.

The x-axis of the first support member and the x-axis of the second support member may be offset relative to each other along the lateral axis and/or the vertical axis of the frame member.

The x-axis of the first support member and the x-axis of the second support member may be parallel, or substantially parallel.

At least a portion of the frame member may be configured to be resilient. The frame member may comprise one or more resilient portions.

The frame member may comprise at least one gripping portion configured to, in use, permit the user to at least partially grip the frame member with the user's foot or feet. The at least one gripping portion may be configured, in use, to engage with one or more regions of the user's foot or feet. The at least one gripping portion may be configured, in use, to engage with a mid portion of the user's foot or feet, a front or toe portion of the user's foot or feet, and/or a rear or heel portion of the user's foot or feet. The at least one gripping portion may be located at or adjacent to the third support member. At least a part of the at least one gripping portion may be located on the at least one foot receiving portion. The at least one gripping portion may be located above the at least one foot receiving portion. The at least one gripping portion may be located below the at least one leg engagement portion. The at least one gripping portion may be located between the at least one foot receiving portion and the at least one leg engagement portion. The at least one gripping portion may be located between the first support member and the second support member. The at least one gripping portion may be located adjacent to the at least one foot receiving portion.

The at least one gripping portion may comprise one or more gripping members configured, in use, to engage with the user's foot or feet. The, or each, gripping portion may comprise two or more, or three or more, gripping members. The one or more gripping members may be configured, in use, to engage with a mid portion of the user's foot or feet, a front or toe portion of the user's foot or feet, and/or a rear or heel portion of the user's foot or feet. One or more of the gripping members may be located at or adjacent to the third support member. One or more of the gripping members may be located on the at least one foot receiving portion. One or more of the gripping members may be located at a front region of the at least one foot receiving portion. One or more of the gripping members may be located at a rear region of the at least one foot receiving portion. One or more of the gripping members may be located at a mid region of the at least one foot receiving portion.

One or more of the gripping members may be a protruding member arranged to protrude from the at least one foot receiving portion. One or more of the gripping members may be a planar member. One or more of the gripping members may be arranged substantially perpendicular to the at least one foot receiving portion.

One or more of the gripping members may be integrally formed with the frame member.

The, or each, gripping portion may comprise two or more gripping members aligned substantially along at least one axis of the frame member. The axis may be the lateral axis. The, or each gripping portion may comprise three or more gripping members aligned substantially along at least one axis of the frame member. The axis may be the lateral axis.

The, or each, gripping portion may include two or more, or three or more, gripping members arranged, in use, to engage with the inside of the user's foot.

The gripping members of the, or each, gripping portion may be spaced apart from each other. The gripping members may be spaced apart along the lateral axis of the frame member.

At least a portion of the at least one gripping portion may be configured to be resilient. The at least one gripping portion may comprise one or more resilient portions. The one or more resilient portions may be configurable, in use, between an uncompressed configuration when not being gripped by the user's foot or feet, and an at least partially compressed configuration when the user's foot or feet grips the one or more resilient portions. The one or more resilient portions may comprise a padded section, a foam member, or the like. The one or more resilient portions may be one or more cover members arranged to cover at least a portion of the frame member. The one or more resilient portions may be made from ethylene-vinyl acetate, polyethylene or foam.

Substantially all of the at least one gripping portion may be configured to be resilient. The one or more resilient portions of the at least one gripping portion may be arranged to cover substantially all of the third support member.

The at least one gripping portion may comprise one or more foot engaging surfaces. The one or more resilient portions of the at least one gripping portion may be located at the one or more foot engaging surfaces of the at least one gripping portion.

The at least one gripping portion may comprise a rounded cross-section, a square cross-section, or a circular cross-section. The one or more foot engaging surfaces of the at least one gripping portion may be arcuate surfaces, or flat surfaces.

The frame member may comprise a fourth support member. The first support member and the second support member may be connected by the third support member and the fourth support member. The third support member and the fourth support member may be spaced apart. The third support member may connect a first end portion of the first support member to a first end portion of the second support member, and the fourth support member may connect a second end portion of the first support member to a second end portion of the second support member. The first end of the first support member and the second end of the first support member may be at opposite ends of the first support member. The first end of the second support member and the second end of the second support member may be at opposite ends of the second support member.

The third support member may have an x-axis and a y-axis arranged orthogonally to the z-axis thereof.

The third support member may be between 150 mm to 300 mm in length along the z-axis thereof.

The third support member may be between 10 mm to 100 mm in width along the y-axis thereof. The third support member may be between 10 mm to 80 mm in width along the y-axis thereof. The third support member may be between 10 mm to 50 mm in width along the y-axis thereof.

The third support member may be shorter than the first support member and/or second support member. The fourth support member may be shorter than the first support member and/or the second support member. The third support member may be substantially the same length as the fourth support member. The third support member may be different in length to the fourth support member. The third support member may be shorter in length than the fourth support member. The third support member may be longer in length than the fourth support member.

At least a portion of the at least one leg engagement portion may be configured to be resilient. The at least one leg engagement portion may comprise one or more resilient portions. The one or more resilient portions may be configurable, in use, between an uncompressed configuration when not in contact with the portion of the user's leg, and an at least partially compressed configuration when the portion of the user's leg is in contact with the one or more resilient portions. The one or more resilient portions may comprise a padded section, a foam member, or the like. The one or more resilient portions may be one or more cover members arranged to cover at least a portion of the frame member. The one or more resilient portions may be made from ethylene-vinyl acetate, polyethylene or foam.

Substantially all of the at least one leg engagement portion may be configured to be resilient. The one or more resilient portions of the at least one leg engagement portion may be arranged to cover substantially all of the first support member.

The at least one leg engagement portion may comprise one or more leg engaging surfaces. The one or more resilient portions of the at least one leg engagement portion may be located at the one or more leg engaging surfaces of the at least one leg engagement portion.

The at least one leg engagement portion may comprise a rounded cross-section, a square cross-section, or a circular cross-section. The one or more leg engaging surfaces may be arcuate surfaces, or flat surfaces.

The frame member may comprise a plurality of leg engagement portions. The at least one leg engagement portion may comprise a first leg engagement portion and a second leg engagement portion. The first leg engagement portion may be arranged, in use, to be in contact with a portion of one of the user's legs, and the second leg engagement portion may be arranged, in use, to be in contact with a portion of the other of the user's legs. The first leg engagement portion and the second leg engagement portion may be spaced apart along the horizontal axis of the frame member. The first leg engagement portion and the second leg engagement portion may be aligned along the horizontal axis of the frame member. At least a portion of the first leg engagement portion and at least a portion of the second leg engagement portion may be positioned either side of the third support member. The first leg engagement portion and the second leg engagement portion may be positioned either side of a centrally positioned third support member which connects the first support member to the second support member.

The frame member may comprise a plurality of foot receiving portions. The frame member may comprise two foot receiving portions.

The at least one foot receiving portion may be configured to permit at least a portion of the user's foot to be located thereon.

The at least one foot receiving portion may comprise one or more planar, or flat, portions for receiving at least a portion of the user's foot thereon. The at least one foot receiving portion may be a plate member, or the like. The at least one foot receiving portion may comprise a flat plate. The at least one foot receiving portion may be contoured to the shape of at least a portion of the user's foot.

At least a portion of the at least one foot receiving portion may be made from substantially the same material as the second support member.

The at least one foot receiving portion may be configured, in use, to grip the user's foot. The at least one foot receiving portion may comprise one or more tread portions configured to increase the grip of the user's foot on the at least one foot receiving portion. The, or each tread portion may include one or more ridges, ridged portions, channels, grooves, or the like. The one or more tread portions of the at least one foot receiving portion may comprise an anti-slip material. The anti-slip material may comprise a specialist anti slip coating. The anti-slip material may comprise roughened material. The roughened material may be a rubber material, such as textured rubber, or the like. The, or each, tread portion may comprise one or more knurled portions, or the like.

The at least one foot receiving portion may be positioned at a mid-portion of the frame member. The foot receiving portions may be arranged at either side of the central portion of the second support member.

The at least one foot receiving portion may comprise a first foot receiving portion and a second foot receiving portion. The first foot receiving portion and the second receiving portion may be positioned at a mid-portion of the frame member. The first foot receiving portion and the second foot receiving portion may be spaced apart. The first foot receiving portion and the second foot receiving portion may be positioned apart along the horizontal axis of the frame member. The first foot receiving portion and the second foot receiving portion may be positioned apart along the x-axis of the second support member. At least a portion of the first foot receiving portion may be positioned at, or adjacent to the first end of the second support member. At least a portion of the second foot receiving portion may be positioned at, or adjacent to the second end of the second support member. The at least one gripping portion may be located adjacent to the first foot receiving portion and/or adjacent to the second foot receiving portion. The at least one gripping portion may be located between the first foot receiving portion and the second foot receiving portion. The first foot receiving portion may be spaced apart from the second foot receiving portion at least in part by the at least one gripping portion. The first foot receiving portion and the second foot receiving portion may be positioned either side of the third support member. The first foot receiving portion and the second foot receiving portion may be positioned either side of the third support member and the third support member may be a centrally positioned third support member which connects the first support member to the second support member.

The at least one foot receiving portion may be configured to be fixed relative to the at least one leg engagement portion.

The apparatus may be configured to permit the frame member, in use, to pivot between a first position and a second position. The first position may be pivotably offset from the second position about at least one axis of the frame member. The first position may be pivotably offset from the second position about the horizontal axis of the frame member.

The apparatus may be configured to permit the at least one foot receiving portion to pivot, in use, between a first position and a second position.

The first position may be pivotably offset from the second position about at least one axis of the frame member. The first position may be pivotably offset from the second position about the horizontal axis of the frame member.

The apparatus may be configured to permit the at least one leg engagement portion to pivot, in use, between a first position and a second position. The first position may be pivotably offset from the second position about at least one axis of the frame member. The first position may be pivotably offset from the second position about the horizontal axis of the frame member.

The apparatus may be configured such that the at least one leg engagement portion remains fixed relative to the at least one foot receiving portion when the at least one leg engagement portion pivots between its first and second position and when the at least one foot receiving portion pivots between its first and second position.

The apparatus may be configured, in use, to permit the at least one foot receiving portion to at least partially pivot about at least one axis of the apparatus. The axis may be the horizontal axis of the frame member.

The apparatus may be configured, in use, to permit the at least one leg engagement portion to at least partially pivot about at least one axis of the apparatus. The axis may be the horizontal axis of the frame member.

The frame member may be mountable to one or more base members operable to raise the frame member, or the at least one foot receiving portion, above the ground. The one or more base members may be operable to permit the frame member to pivot relative to the, or each, base member. The one or more base members may be operable to permit the frame member to pivot relative thereto about the horizontal axis of the frame member. The frame member may be operable to receive one or more weights thereon. The frame member may be operable to receive one or more weights configured to raise the at least one foot receiving portion above the ground. The frame member may be operable to receive one or more weights configured to permit the frame member to pivot relative thereto. The frame member may be operable to receive one or more weights configured to permit the frame member to pivot relative thereto about the horizontal axis of the frame member. The, or each base member may be a weight, a weight plate, an Olympic weight plate, a disc member, a plate member, or the like.

The apparatus may be configured, in use, to permit pivoting of the leg engagement portion and/or the foot receiving portion when the frame member is mounted to the, or each, base member.

The apparatus may be configured, in use, to permit pivoting of the leg engagement portion when the one or more weights configured to raise the at least one foot receiving portion above the ground have been added to the frame member.

At least a portion of the at least one foot receiving portion may be arranged to be rotationally offset about at least one axis of the frame member. At least a portion of the at least one foot receiving portion may be arranged to be rotationally offset about the horizontal axis of the frame member by an angle of between approximately 30 degrees and approximately −30 degrees relative to the second plane of the frame member, optionally by between approximately 25 degrees and −25 degrees from the second plane of the frame member, optionally by between approximately 18 degrees and approximately −18 degrees from the second plane of the frame member.

The foot receiving portion may comprise one or more sloped portions. The foot receiving portion may comprise one or more inclined portions. The foot receiving portion may comprise one or more declined portions. The foot receiving portion may comprise one or more planar portions and one or more inclined portions. The foot receiving portion may comprise one or more planar portions and one or more declined portions. The foot receiving portion may comprise one or more inclined portions and/or one or more declined portions. The foot receiving portion may comprise one or more planar portions, one or more inclined portions and/or one or more declined portions.

The inclined portion of the foot receiving portion may be located at an end region of the foot receiving portion. The declined portion of the foot receiving portion may be located at an end region of the foot receiving portion. The planar portion of the foot receiving portion may be located at an end region of the foot receiving portion.

The planar portion and the inclined portion of the foot receiving portion may be located at opposite regions of the foot receiving portion. The planar portion and the inclined portion of the foot receiving portion may be located at opposite end regions of the foot receiving portion.

The planar portion and the declined portion of the foot receiving portion may be located at opposite regions of the foot receiving portion. The planar portion and the declined portion of the foot receiving portion may be located at opposite end regions of the foot receiving portion.

The inclined portion or declined portion may be located at a rear portion of the foot receiving portion. The planar portion of the foot receiving portion may be located at a front region of the foot receiving portion.

At least a portion of the foot receiving portion may have a curved profile. The at least one foot receiving portion may have a curved profile through at least a part of the length thereof.

The at least one foot receiving portion may have comprise an arced section. The at least one foot receiving portion may be substantially arc shaped.

The foot receiving portion may comprise a substantially concave profile.

The foot receiving portion may have a partially cylindrical cross section.

A first region of the foot receiving portion may be arranged such that it is non-planar with respect to the second plane of the frame member and a second region of the foot receiving portion may be arranged such that it is substantially planar with respect to the second plane of the frame member.

The first region of the foot receiving portion may be arranged such that it is non-planar with respect to the second plane of the frame member and a second region of the foot receiving portion may be arranged such that it is substantially planar with respect to the second plane of the frame member.

The first region may be arranged to receive the heel of the user's foot, and the second region may be arranged to receive the ball of the user's foot. The first region and the second region may each be arranged to receive either the heel or ball of the user's foot.

The at least one foot receiving portion may be arranged to be inclined when the at least one foot receiving portion is in the first position. At least a portion of the at least one foot receiving portion may be arranged to be inclined when the at least one foot receiving portion is in the first position. At least a portion of the at least one foot receiving portion may be arranged to be declined when the at least one foot receiving portion is in the first position.

The at least one foot receiving portion may be arranged on a plane that is angularly offset from the second plane of the frame member. The at least one foot receiving portion may be arranged on a plane that is angularly offset from the second plane of the frame member about the horizontal axis of the frame member.

The frame member may comprise a connector for a cable, or the like. The connector may be configured to receive, or connect with, a cable or the like, or may be configured to receive, or connect with, a connector of the cable or the like. The cable may be a cable for an exercise apparatus, or the like, as is known in the field of cable-based exercise machines.

The frame member may comprise a single connector, or one or more connectors.

The connector may be integrally formed with the frame member. The connector may be fixed relative to the frame member.

The connector may be a loop member, a hoop member, a hook, or the like. The connector may be a protruding member, an elongate member, or the like. The connector may be a female connector or a male connector. The second support member may comprise the connector.

The connector may be located at, or adjacent to, the second support member. The connecter may be located perpendicular to the third support member. The third support member may comprise the connector. The connecter may be located at, or adjacent to the third support member. The connector may be arranged substantially parallel to the at least one foot receiving portion. The connector may be arranged between the first foot receiving portion and the second foot receiving portion. The connector may be located adjacent to, or at, the at least one foot receiving portion.

In use, the connector may be arranged between a user's ankles or feet.

The connector may be suitable for connecting the frame member to a means of resistance. The connector may be suitable for connecting the frame member to one or more weights. The connector may be suitable for connecting the frame member to one or more cables, or the like. The connector may be suitable for connecting the frame member to a rope, or the like. The connector may be suitable for connecting the frame member to an elasticated cord, or the like. The connector may be suitable for connecting the frame member to a resistance band, or the like. The connector may be suitable for connecting the frame member to a further connector. The further connector may be a hook, a loop, a hoop, a protruding member, or the like. The connector may be suitable to attach the frame member to a cable machine, or the like.

The connector may be defined, at least in part, by one or more of the gripping member(s) of the at least one gripping portion. In this arrangement, at least a part of the connector may be configured to engage with the user's foot or feet. The connector may be configured to engage with a rear portion or heel of the user's foot. The connector may be configured to conform to the user's foot, or a rear portion or heel portion thereof. At least a portion of the connector may comprise a knurled portion. The knurled portion may comprise sharp, deep, coarse or dulled knurling. The knurled portion may comprise sharp and deep knurling.

The second support member may be configured to be fixed relative to the first support member.

The apparatus may be configured to permit the second support member to pivot, in use, between a first position and a second position. In the first position, the x-axis of the second support member may be arranged along the horizontal axis of the frame member. In the second position, the x-axis of the second support member may be pivotably offset from the first position about the horizontal axis of the frame member.

The apparatus may be configured to permit the first support member to pivot, in use, between a first position and a second position. In the second position, the x-axis of the second support member may be arranged along the horizontal axis of the frame member. In the first position, the x-axis of the second support member may be pivotably offset from the second position about the horizontal axis of the frame member.

The apparatus may be configured such that the at first support member remains fixed relative to the second support member when the first support member pivots between its first and second position and when the second member support pivots between its first and second position.

The apparatus may be configured, in use, to permit the second support member to at least partially pivot about at least one axis of the apparatus. The axis may be the horizontal axis of the frame member.

The apparatus may be configured, in use, to permit the first support member to at least partially pivot about at least one axis of the apparatus. The axis may be the horizontal axis of the frame member.

The one or more base members may be operable to raise the second support member above the ground. The frame member may be operable to receive one or more weights configured to raise the second support member above the ground.

The apparatus may be configured, in use, to permit pivoting of the first support member and/or the second support member when the frame member is mounted to the, or each, base member.

The apparatus may be configured, in use, to permit pivoting of the first support member when the one or more weights configured to raise the second support member above the ground have been added to the frame member.

The foot receiving portion may comprise one or more foot receiving surfaces on which the user's foot can rest. The, or each foot receiving surface of the foot receiving portion may be arranged on a plane that is angularly offset from the first plane of the frame. The, or each, foot receiving surface of the foot receiving portion may be arranged on a plane that is angularly offset from the second plane of the frame member.

The, or each foot receiving surface of the foot receiving portion may be arranged on a plane that is angularly offset from the first plane of the frame member about the horizontal axis of the frame. The, or each foot receiving surface of the foot receiving portion may be arranged on a plane that is angularly offset from the second plane of the frame member about the horizontal axis of the frame member.

The at least one foot receiving portion may be arranged substantially on a plane that is offset from the first plane and/or the second plane of the frame member. The at least one foot receiving portion may be offset such that when the user's foot or feet engages the at least one foot receiving portion and pivots the foot receiving portion, the first plane and the second plane of the frame member tilts such that the leg engagement portion moves towards and engages the user's shins.

The frame member may comprise one or more weight receiving portions. The, or each, weight receiving portion may be configured to be engageable with one or more weights. The, or each, weight receiving portion may be configured to receive one or more weights thereon. The one or more weight receiving portions may be configured to be engageable with one or more base members.

The one or more weight receiving portions may be configured to receive an adapter, the adapter being operable to engage with one or more weights. The adapter may convert the, or each, weight receiving portion from being compatible with a first type, or size of weight to a second type, or size of weight.

The weight may be a weight plate, Olympic plate, barbell plate, dumbbell plate, plate member, or the like. The weight may be a disc member. The weight may be a planar member. The, or each weight receiving portion may be configured to engage with a plurality of stackable weights.

The weight(s) may be configured to raise the at least one foot receiving portion above the ground.

The, or each weight receiving portion may comprise a weight engaging portion. The weight engaging portion may be an elongate member, a bar, or the like.

The apparatus may be operable to lock/retain a weight to the, or each, weight receiving portion. The apparatus may comprise one or more retaining members operable to retain/lock a weight to the, or each, weight receiving portion. The retaining members/locking members may be a collar member, a clamp member, or the like.

The, or each, weight receiving portion may include a stop member arranged to abut at least a portion of at least one weight when the weight is engaged with the weight receiving portion. The stop member may be a flange, or the like.

The, or each, weight receiving portion may be located at a region of the frame member. The weight receiving portions may be located at end regions of the frame member. The first end portion of the frame member and/or the second end portion of the frame member may comprise a weight receiving portion. The weight receiving portions may be configured to support a weight plate. The weight receiving portions may be spaced apart from the foot receiving portion and the leg engagement portion. The one or more weight receiving portions may be perpendicular to the foot receiving portion and/or leg engagement portion.

The, or each, weight receiving portion may be arranged substantially along the horizontal axis of the frame member. The, or each, weight receiving portion may comprise an x-axis. The x-axis of the, or each, weight receiving portion may be arranged along the horizontal axis of the frame member. The frame member may be configured, in use, to pivot about the, or each, weight receiving portion. The frame member may be configured, in use, to pivot about the x-axis of the, or each weight receiving portion.

The apparatus may be configured to be connectable to one or more further exercise apparatuses. The apparatus may be configured to be connectable to one or more resistance bands, one or more cable members, or the like. The leg exercise apparatus may be operable to be used in combination with a further exercise apparatus. The further exercise apparatus may be configured such that it provides resistance for the leg exercise apparatus. The weight receiving portion (s) may be configured so that connection can be made to an external weight training apparatus. The external weight training apparatus may provide resistance for the leg exercise apparatus.

The frame member may be made from a metal material or a composite material. The composite material may comprise carbon fibre. The metal may be stainless steel or aluminium.

The frame member may comprise a generally circular, oval, square, rectangular or rhombic shape.

The frame member may be between 500 mm and 1,000 mm in length along the horizontal axis thereof. The frame member may be between 600 mm and 900 mm in length along the horizontal axis thereof. The frame member may be between 700 mm and 800 mm in length thereof.

The first support member may comprise a bar, rod, tube or cylinder. The shape of the cross section of the first support member may comprise a cross section which is square, circle, rectangle, oval, or any other shape known in the art.

The second support member may comprise a bar, rod, tube or cylinder. The shape of the cross section of the second support member may comprise a cross section which is square, circle, rectangle, oval, or any other shape known in the art.

The third support member may comprise a bar, rod, tube or cylinder. The shape of the cross section of the third support member may comprise a cross section which is square, circular, rectangular, oval, or any other suitable shape.

The fourth support member may comprise a bar, rod, tube or cylinder. The shape of the cross section of the fourth support member may comprise a cross section which is square, circular, rectangular, oval, or any other suitable shape.

The frame member may be a substantially one-piece member. The frame member may be integrally formed. In this arrangement, the components of the frame member are integrally formed to define the complete frame member. The first support member, the second support member, the third support member and/or the fourth support member may be integrally formed.

At least a portion of the leg engaging portion may be integrally formed with the first support member. The first support member may be integrally formed with the third support member. The third support member may be integrally formed with the second support member. The second support member may be integrally formed with at least a portion of the at least one foot receiving portion. The second support member may be integrally formed with the, or each, weight receiving portion. The first support member, the second support member, the third support member, the at least one leg engagement portion, the at least one foot receiving portion and/or the one or more weight receiving portions may be integrally formed.

The first support member, second support member, third support member and fourth support member may have substantially the same shape of cross section. The first support member, second support member, third support member and fourth support member may comprise a different shape of cross section.

The first support member, second support member, third support member and fourth support member may comprise the same material. The first support member, second support member, third support member and fourth support member may comprise one or more different materials.

The leg exercise apparatus may be used by a user in a seated position, a prone position, when lying down or when lying on their front.

The apparatus may be configured to be suitable for use for exercising the hamstring muscles, adductor muscles, bicep muscles, gastrocnemius muscles, gluteus muscles, quadriceps femoris muscle, sartorius muscle, soleus muscle, calf muscles or any combination thereof. The apparatus may be configured to be suitable for isolating the gluteal, hamstring and/or calf muscles.

The at least one foot receiving portion may be movable relative to the one or more weight receiving portions. The frame member may be configured to permit the at least one foot receiving portion to move between a first position and a second position relative to the one or more weight receiving portions. The first position may be pivotably offset from the second position. The first position may be pivotably offset from the second position about at least one axis of the frame member. The first position may be pivotably offset from the second position about the horizontal axis of the frame member. The first position and the second position may be angularly offset by between 0 degrees and 50 degrees, optionally between 0 degrees and 45 degrees, optionally between 15 degrees and 50 degrees, optionally between 25 degrees and 45 degrees, optionally between 30 degrees and 45 degrees.

The at least one foot receiving portion may be pivotably connected to the one or more weight receiving portions, such that the at least one foot receiving portion can pivot relative to the one or more weight receiving portions.

The second support member may be pivotably connected to the one or more weight receiving portions, such that the second support member can pivot relative to the one or more weight receiving portions.

The frame member may comprise one or more pivots configured to permit the at least one foot receiving portion to pivot relative to the one or more weight receiving portions. The one or more pivots may comprise one or more bearings, or the like. The one or more pivots may be located between the second support member and the, or each, weight receiving portion.

According to a second aspect of the invention there is provided a method of using a leg exercise apparatus, the method comprising the steps of:

providing a leg exercise apparatus, the leg exercise apparatus comprising a frame member, the frame member including:

at least one foot receiving portion; and at least one leg engagement portion;

wherein the at least one leg engagement portion is spaced from the at least one foot receiving portion such that, in use, when a user's foot is located on the at least one foot receiving portion, the at least one leg engagement portion may contact a portion of the user's leg;

placing at least one foot on the at least one foot receiving portion;

positioning at least one leg in engagement with the at least one leg engagement portion; and raising the leg exercise apparatus by flexing the at least one leg that is in engagement with the at least one foot receiving portion of the leg exercise apparatus.

Embodiments of the second aspect of the present invention may include one or more features of the first aspect of the present invention or its embodiments. Similarly, embodiments of the first aspect of the present invention may include one or more features of the second aspect of the present invention or its embodiments.

BRIEF DESCRIPTION OF THE DRAWINGS

Embodiments of the invention will now be described, by way of example, with reference to the drawings, in which.

DESCRIPTION OF PREFERRED EMBODIMENTS

With reference to FIGS. 1 to 9*b*, a leg exercise apparatus 100 is shown. The apparatus 100 includes a frame member 102.

Figure 1:
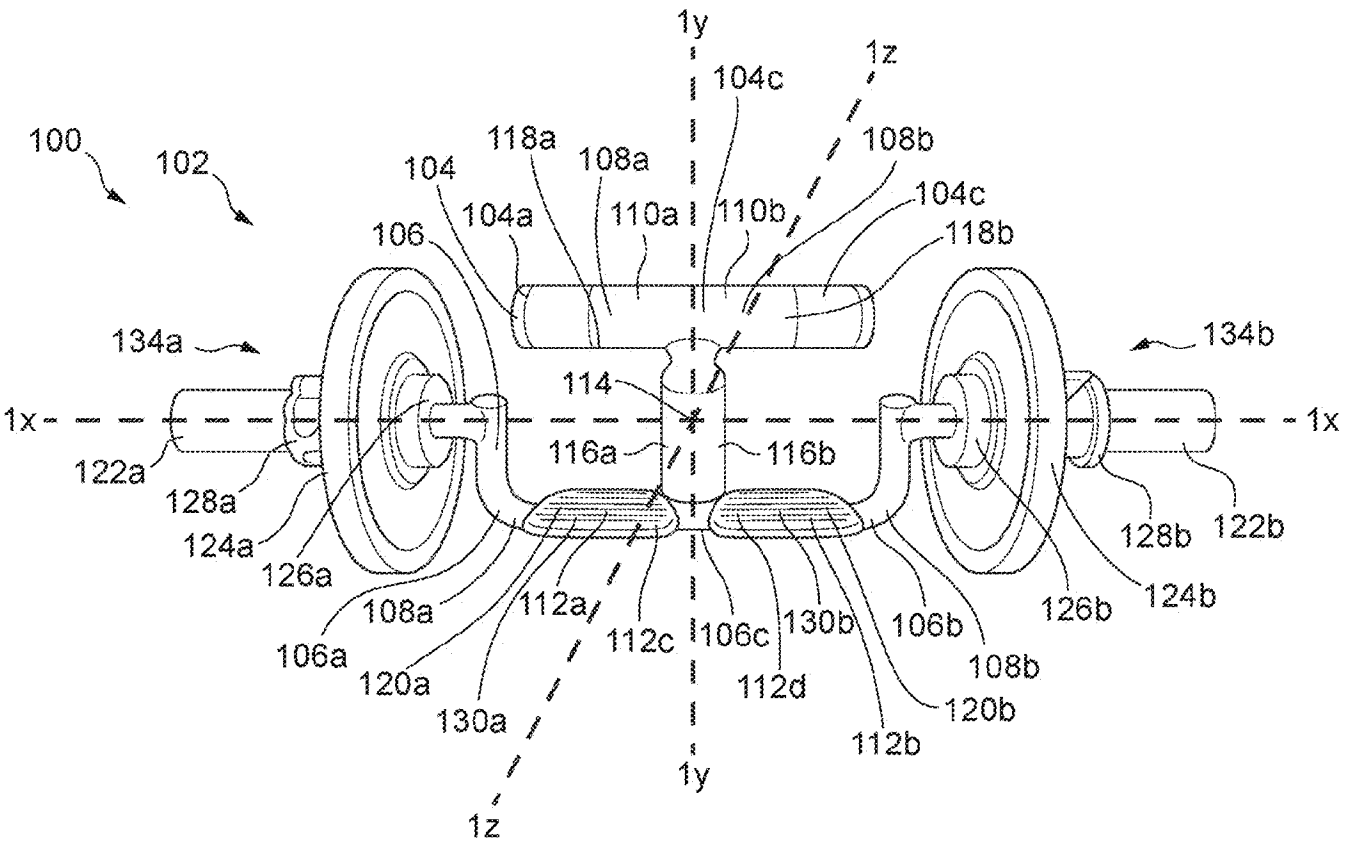
FIG. 1 shows a front view of an embodiment of a leg exercise apparatus in accordance with an aspect of the invention.

As illustrated in FIG. 1, the frame member 102 comprises a horizontal axis 1*x*, a vertical axis 1*y* and a lateral axis 1*z*. The frame member 102 comprises several elongate members and is a barbell. The frame member 102 is a substantially one-piece member, and is integrally formed. In this embodiment, the components of the frame member 102 are integrally formed to define the complete frame member 102.

A first plane of the frame member 102 is defined by the horizontal axis 1*x* and the vertical axis 1*y* of the frame member 102. A second plane of the frame member 102 is defined by the horizontal axis 1*x* and the lateral axis 1*z* of the frame member 102.

With reference to FIG. 1, the frame member 102 comprises a first support member 104 and a second support member 106. The first support member 104 is an elongate member. The second support member 106 is an elongate member. The first support member 104 and the second support member 106 are spaced apart along the vertical axis 1*y* and the lateral axis 1*z* of the frame member 102. The first support member 104 is substantially parallel to the second support member 106. The first support member 104 is shorter in length than the second support member 106.

The first support member 104 includes a leg engagement portion, which in this embodiment includes a first leg engagement portion 108*a* and a second leg engagement portion 108*b*. The leg engagement portion is located on the first support member 104.

The first leg engagement portion 108*a* comprises a first resilient portion 110*a*. The second leg engagement position 108*b* comprises a second resilient portion 110*b*. The first resilient portion 110*a* and the second resilient portion 110*b* are formed from a padded section, which spans substantially all of the first support member 104. It will be understood that the leg engagement portion of the apparatus 100 could be arranged in a different way and could be formed from a different type of resilient portion.

The second support member 106 includes a first foot receiving portion 112*a* and a second foot receiving portion 112*b*. The first foot receiving portion 112*a* and the second foot receiving portion 112*b* are integrally formed with a portion of the second support member 106. The first foot receiving portion 112*a* and second foot receiving portion 112*b* are spaced apart along the horizontal axis 1*x* of the frame member 102.

The first support member 104 comprises a first end portion 104*a*, a second end portion 104*b* and a central portion 104*c*. The second support member 106 comprises a first end portion 106*a*, a second end portion 106*b* and a central portion 106*c*.

The frame member 102 comprises a third support member 114. The third support member 114 is elongate substantially in the direction of the vertical axis 1*y* of the frame member 102. The central portion 104*c* of the first support member 104 and the central portion 106*c* of the second support member 106 are connected by the third support member 114.

The third support member 114 is substantially perpendicular to the first support member 104 and the second support member 106.

The first support member 104 and the second support member 106 are angularly offset with respect to the vertical axis 1*y* of the frame member 102 about the horizontal axis 1*x* of the frame member 102.

The third support member 114 is angularly offset with respect to the vertical axis 1*y* of the frame member 102 about the horizontal axis 1*x* of the frame member 102.

The third support member 114 is shorter along its elongate direction than the first support member 104 and the second support member 106 along their respective elongate directions.

The leg engagement portion comprises a first leg engaging surface 118*a* and a second leg engaging surface 118*b*. The leg engagement portion has a circular cross section. The first leg engaging surface 118*a* and the second leg engaging surface 118*b* are arcuate surfaces. The first and second leg engaging surfaces 118*a*, 118*b* engage the user's shins when the apparatus 100 is used.

Figure 3:
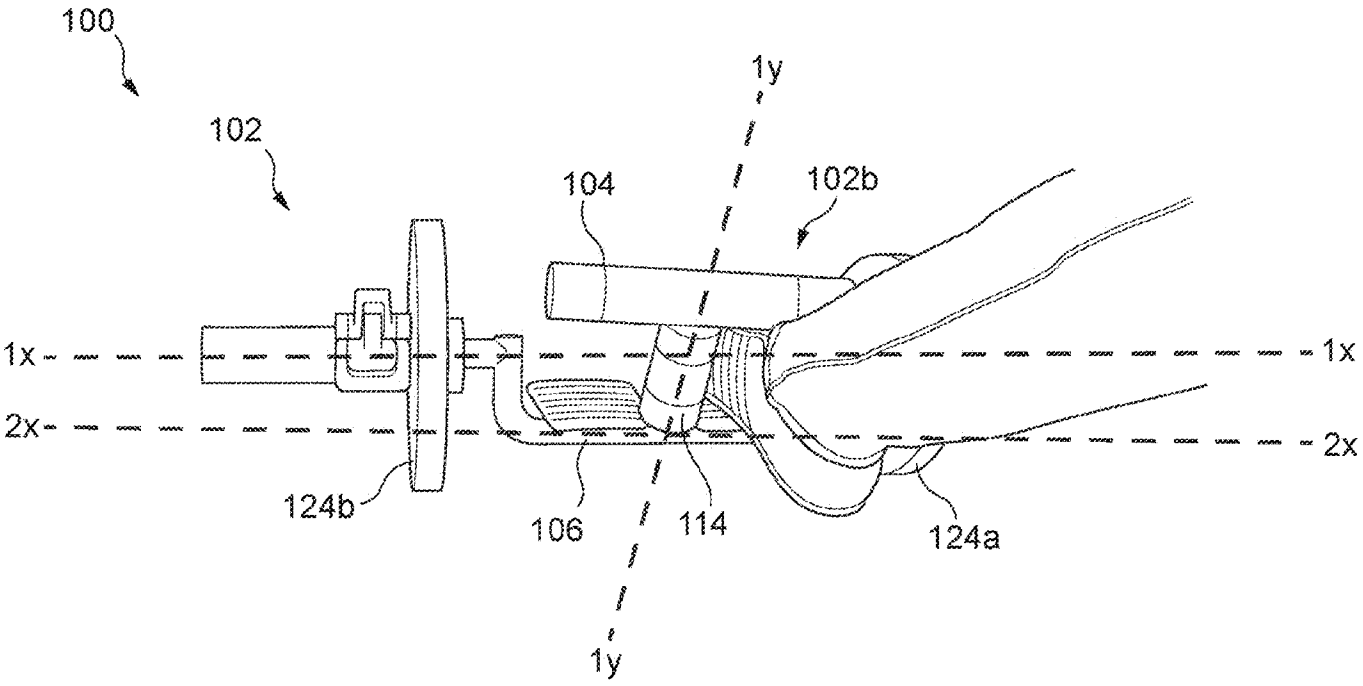
FIG. 3 shows the leg exercise apparatus of FIG. 1 in an offset position prior to use.

The first leg engagement portion 108*a* is arranged, in use, to be in contact with a portion of the user's leg, and the second leg engagement portion 108*b* is arranged, in use, to be in contact with a portion of the user's other leg. FIG. 3 shows the second leg engagement portion 108*a* in contact with one of the user's shins. This engagement of the leg engagement portion with the user's legs helps to stabilise the leg exercise apparatus 100 in use. The first leg engagement portion 108*a* and the second leg engagement portion 108*b* are spaced apart along the horizontal axis 1*x* of the frame member 102. The first leg engagement portion 108*a* and the second leg engagement portion 108*b* are positioned on either side of the centrally positioned third support member 114, which connects the first support member 104 and the second support member 106 together.

The first and second foot receiving portions 112*a*, 112*b*, each comprise a planar or flat portion for receiving at least a portion of the user's foot thereon. The first foot receiving portion 112*a* comprises a plate member 112*c* for receiving at least a portion of the user's foot thereon and the second foot receiving portion 112*b* comprises a plate member 112*d* for receiving at least a portion of the user's foot thereon.

The first foot receiving portion 112*a* and the second foot receiving portion 112*b* are configured to grip the user's foot. The first and second foot receiving portions 112*a*, 112*b*, each comprise a tread portion 130*a*, 130*b* configured to increase the grip on the user's foot on the first and second foot receiving portions 112*a*, 112*b*. In the embodiments illustrated and described here, the tread portions 130*a*, 130*b* include textured rubber.

The first foot receiving portion 112*a* is adjacent to the first end 106*a* of the second support member 106. The second foot receiving portion 112*b* is adjacent to the second end 106*b* of the second support member 106.

The third support member 114 comprises a gripping portion, which is configured to permit the user to grip the third support member 114 with their feet. A first gripping portion 116*a* is located adjacent to the first foot receiving portion 112*a*. A second gripping portion 116*b* is located adjacent to the second foot receiving portion 112*b*. In this embodiment, the first and second gripping portions 116*a*, 116*b* include resilient portions, which are padded sections on the third support member 114.

The first foot receiving portion 112*a* and the second foot receiving portion 112*b* are positioned either side of the centrally positioned third support member 114, which connects the first support member 104 to the second support member 106.

The apparatus 100 is configured to permit the frame member 102, in use, to pivot between a first position 102*a* (FIG. 4) and a second position 102*b* (FIG. 3). The first position 102*a* is pivotably offset from the second position 102*b* about the horizontal axis 1*x* of the frame member 102.

The apparatus 100 is configured to permit the first foot receiving portion 112*a* and the second foot receiving portion 112*b* to pivot, in use, between a first position and a second position. The first position is pivotably offset from the second position about the horizontal axis 1*x* of the frame member 102.

The apparatus 100 is configured to permit the first leg engagement portion 108*a* and the second leg engagement portion 108*b* to pivot, in use, between a first position and a second position. The first position is pivotably offset from the second position about the horizontal axis 1*x* of the frame member 102.

Figure 4:
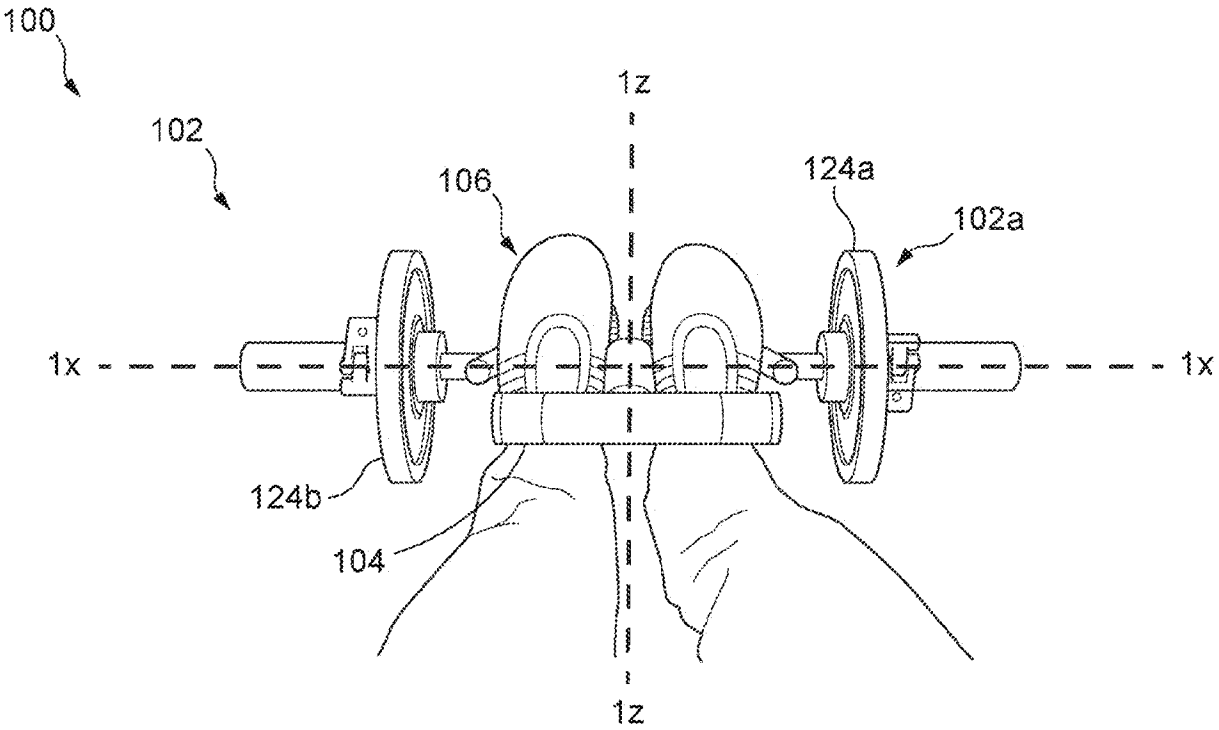
FIG. 4 shows the leg exercise apparatus of FIG. 1 in a first position while in use.

As will be described in more detail below, the pivoting of the frame member 102 is particularly useful when performing a hamstring curl exercise with the apparatus 100, as the user can "walk in" to the apparatus 100 (as shown in FIG. 4), while it is resting on the floor, and curl the apparatus 100 to perform the exercise (the start of the curl shown for illustrative purposes in FIG. 3, with one foot). Coupled with the arrangement of the foot receiving portions and leg engagement portions, there is therefore no need for the apparatus 100 to be lifted by another person, or mounted to a stand or other piece of exercise equipment, to be used. The apparatus 100 can instead be used by a single person, by walking in, or stepping in, to the frame member 102, lying flat on a bench, or the like, and curling the frame member 102 in a hamstring curl motion, due to the ability of the frame member 102 to pivot, and the arrangement of the foot receiving portions and the leg engagement portion.

The apparatus 100 is configured such that the first leg engagement portion 108*a* and the second leg engagement portion 108*b* remain fixed relative to the first foot receiving portion 112*a* and the second foot receiving portion 112*b* when the first leg engagement portion 108*a* and the second leg engagement portion 108*b* pivot between their first and second positions and when the first foot receiving portion 112*a* and second foot receiving portion 112*b* pivot between their first and second positions.

The frame member 102 comprises a first base member 124*a* and a second base member 124*b* operable to raise the frame member 102 above the ground. The first base member 124*a* and the second base member 124*b* are operable to raise the first foot receiving portion 112*a* and the second foot receiving portion 112*b* above the ground. The first base member 124*a* and the second base member 124*b* are operable to permit the frame member 102 to pivot relative to the first base member 124*a* and the second base member 124*b*. Alternatively, if the base members 124*a* and 124*b* become immovable relative to the frame member 102, the frame member 102 can be pivoted about its horizontal axis 1*x* by rolling the apparatus 100 on the ground, as the base members 124*a*, 124*b* are disc-shaped. In the embodiments illustrated and described here, the first base member 124*a* is a first weight plate and the second base member 124*b* is a second weight plate. It will be understood that in other embodiments, the base members 124*a*, 124*b* could be any suitable base members for raising the frame member 102 above the ground.

In the embodiments illustrated and described here, the frame member 102 is operable to receive a plurality of first weights (example first base members 124*a*) and a plurality of second weights (example second base members 124*b*) and the addition of the weights to the frame member permits the frame member 102 to pivot about the horizontal axis 1*x* of the frame member 102.

The apparatus 100 is configured, in use, to permit pivoting of the first leg engagement portion 108*a*, the second leg engagement portion 108*b*, the first foot receiving portion 112*a* and the second foot receiving portion 112*b* when the frame member 102 is mounted to each base member 124*a*,

124*b*. These components of the frame member 102 can therefore pivot in use, when the user curls the apparatus 100. It will be understood that the use of the apparatus 100 has been described with reference to hamstring curls, but other uses of the apparatus 100 will be readily apparent to those of skill in the art.

Figure 2:
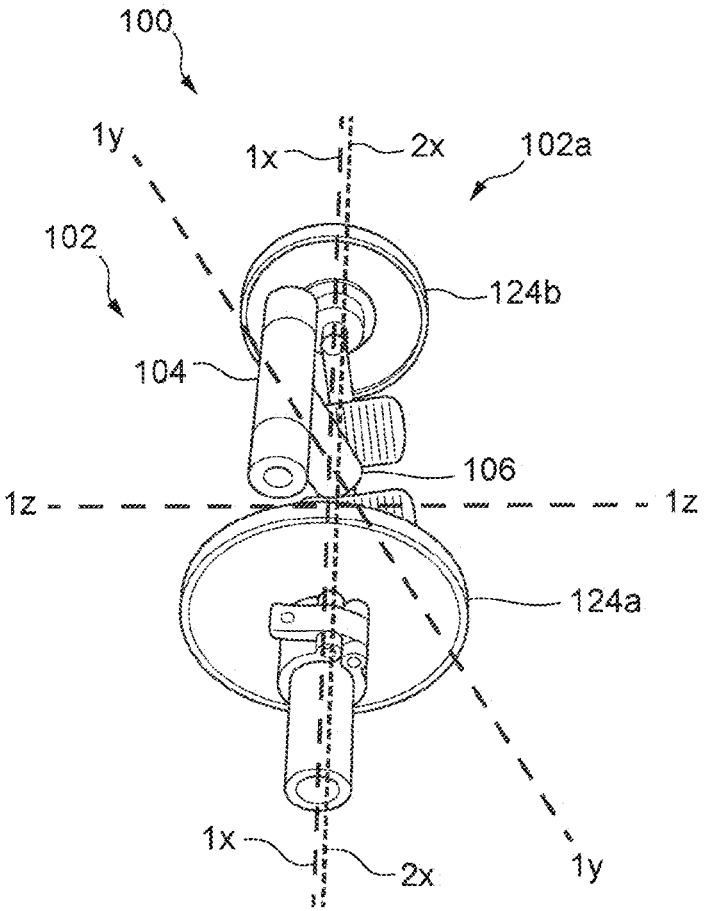
FIG. 2 shows a side view of the leg exercise apparatus of FIG. 1.

As best shown in FIG. 2, the first foot receiving portion 112*a* and the second foot receiving portion 112*b* are arranged to be inclined when the first foot receiving portion 112*a* and the second foot receiving portion 112*b* are in the first position.

As shown in FIG. 2, the first foot receiving portion 112*a* and the second foot receiving portion 112*b* are arranged on a plane that is angularly offset from the second plane of the frame member 102. In this embodiment, the first foot receiving portion 112*a* and the second foot receiving portion 112*b* are arranged on a plane that is angularly offset from the second plane of the frame member about the horizontal axis 1*x* of the frame member 102.

The second support member 106 is configured to be fixed relative to the first support member 104.

As illustrated in FIGS. 2 and 3, the apparatus 100 is configured to permit the second support member 106 to pivot, in use, between a first position and a second position. In the first position an x-axis 2*x* of the second support member 106 is arranged along the horizontal axis 1*x* of the frame member 102. In the second position, the x-axis 2*x* of the second support member 106 is pivotably offset from the first position about the horizontal axis 1*x* of the frame member 102.

The apparatus 100 is configured such that the first support member 104 remains fixed relative to the second support member 106 when the first support member 104 pivots between its first and second position and when the second support member 106 pivots between its first and second position.

The apparatus 100 is configured, in use, to permit the second support member 106 to at least partially pivot about the horizontal axis 1*x* of the frame member 102.

The apparatus 100 is configured, in use, to permit the first support member 104 to pivot about the horizontal axis 1*x* of the frame member 102.

The apparatus 100 is configured, in use, to permit pivoting of the first support member 104 and the second support member 106 when the frame member 102 is mounted to the first base member 124*a* and the second base member 124*b*.

The apparatus 100 is configured, in use, to permit pivoting of the first support member 104 when the first weight and the second weight have raised the second support member 106 above the ground.

As illustrated in FIG. 1, the first foot receiving portion 112*a* comprises a first foot receiving surface 120*a*, and the second foot receiving portion 112*b* comprises a second foot receiving surface 120*b* on which the user's foot can rest. The first foot receiving portion 112*a* and the second foot receiving portion 112*b* are arranged on a plane that is angularly offset from the first plane of the frame member 102. The first foot receiving surface 120*a* of the first foot receiving portion 112*a* and the second foot receiving surface 120*b* of the second foot receiving portion 112*b* are arranged on a plane that is angularly offset from the second plane of the frame member 102.

The first foot receiving surface 120*a* of the first foot receiving portion 112*a* and the second foot receiving surface 120*b* of the second foot receiving portion 112*b* are arranged on a plane that is angularly offset from the first plane of the frame member 102 about the horizontal axis 1*x* of the frame member 102 when in the first position 102*a*. The first foot receiving surface 120*a* of the first foot receiving portion 112*a* and the second foot receiving surface 120*b* of the second foot receiving portion 112*b* are arranged on a plane that is angularly offset from the second plane of the frame member 102 about the horizontal axis 1*x* of the frame member 102 when in the first position 102*a*.

The frame member 102 comprises a first weight receiving portion 122*a* and a second weight receiving portion 122*b*. The first weight receiving portion 122*a* is engageable with the first weight(s) and the second weight receiving portion 122*b* is engageable with the second weight(s). It is envisaged that any number of weight receiving portions could be used.

In this embodiment, the first and second weights are Olympic plates. It is envisaged that the weights could be weight plates, Olympic plates, barbell plates, dumbbell plates, and/or plate members, or the like. The weights are substantially planar disc members and each weight receiving portion is configured to engage with stackable weights. The weight receiving portions 122*a*, 122*b* are configured to receive an adapter, the adapter being operable to engage with the weights. The adapter converts each weight receiving portion 122*a*, 122*b* from being compatible with a first type, or size of weight to a second type, or size of weight.

The first weight and the second weight are configured to raise the first foot receiving portion 112*a* and the second foot receiving portion 112*b* above the ground.

The first weight receiving portion 122*a* comprises a first stop member 126*a* arranged to abut at least a portion of the first weight when the first weight is engaged with the first weight receiving portion 122*a*. The second weight receiving portion 122*b* comprises a second stop member 126*b* arranged to abut at least a portion of the second weight when the second weight is engaged with the second weight receiving portion 122*b*. In this embodiment, the first and second stop members 126*a*, 126*b* are flanges.

The apparatus 100 is operable to retain the first weight to the first weight receiving portion 122*a* and the second weight to the second weight receiving portion 122*b*. The first weight receiving portion 122*a* includes a first retaining member 128*a*. The second weight receiving portion 122*b* includes a second retaining member 128*b*. In this embodiment, the retaining members 128*a*, 128*b* are collars. It is envisaged that any number of retaining members may be used to suit the number of weight receiving portions.

The first weight receiving portion 122*a* and the second weight receiving portion 122*b* are located at a region of the frame member 102. A first end portion 134*a* of the frame member 102 is configured to comprise the first weight(s) and a second end portion 134*b* of the frame member 102 is configured to comprise the second weight(s).

The first weight receiving portion 122*a* and the second weight receiving portion 122*b* are spaced apart from the first foot receiving portion 112*a* and the second foot receiving portion 112*b*. The first weight receiving portion 122*a* and the second weight receiving portion 122*b* are spaced apart from the first leg engagement portion 108*a* and the second leg engagement portion 108*b*.

As is shown in FIG. 3 and FIG. 4, when the user applies their weight to the first foot receiving portion 112*a* and the second foot receiving portion 112*b*, the frame 102 rotates around the horizontal axis 1*x* of the frame member 102 from the first position 102*a* to the second position 102*b*.

Figure 5:
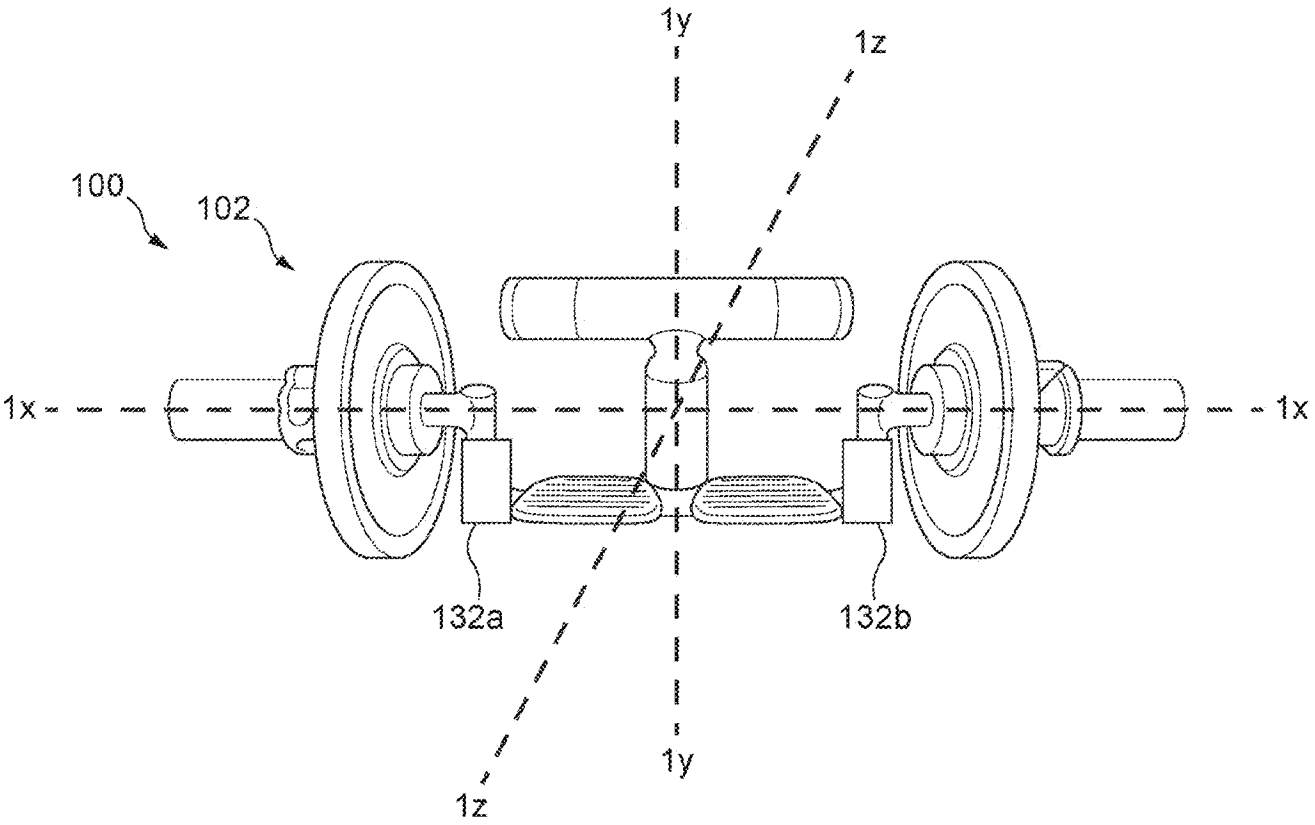
FIG. 5 shows an alternative embodiment of the leg exercise apparatus of FIG. 1.

FIG. 5 shows an alternative embodiment of the apparatus 100. The apparatus is substantially identical to that shown in FIGS. 1 to 4, where additionally the first end 106*a* of the second support member 106 comprises a first pivot 132*a* and the second end 108*b* of the second support member 108 comprises a second pivot 132*b*.

In the alternative embodiment shown in FIG. 5, the foot receiving portions 112*a*, 112*b* are movable relative to the weight receiving portions 122*a*, 122*b*. The frame member 102 is configured to permit the at least one foot receiving portion to move between a first position and a second position relative to the one or more weight receiving portions 122*a*, 122*b*. The first position is pivotably offset from the second position about the horizontal axis 1*x* of the frame member 102. The first position and the second position are angularly offset by between 30 degrees and 45 degrees.

In the embodiment shown in FIG. 5, the pivots 132*a*, 132*b* comprise one or more bearings.

Figure 6:
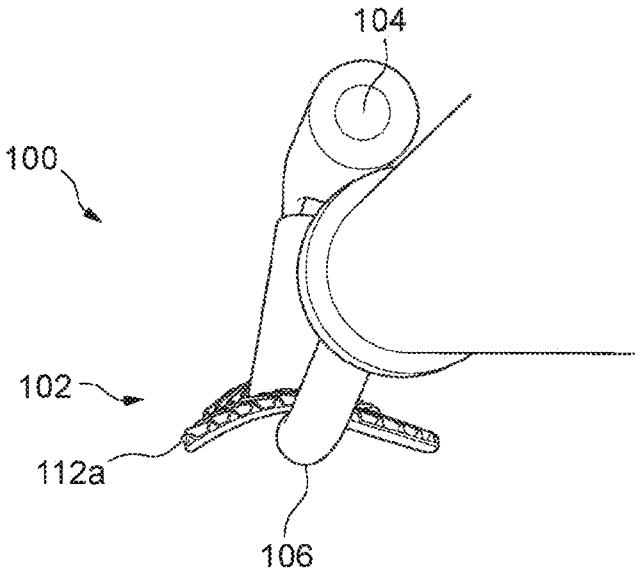
FIG. 6 shows another alternative embodiment of the leg exercise apparatus of FIG. 1.
Figure 7:
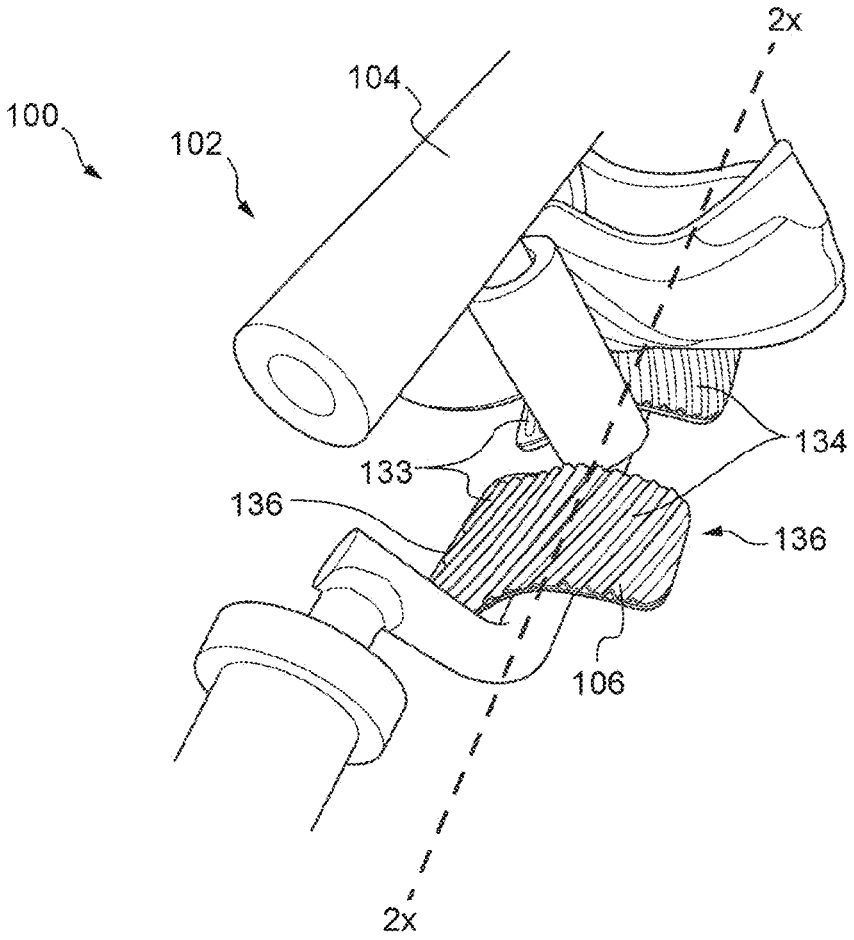
FIG. 7 shows another view of the embodiment of FIG. 6.

FIG. 6 and FIG. 7 show an alternative embodiment of the apparatus 100. The apparatus 100 is substantially identical to that shown in FIGS. 1 to 4, where additionally the foot receiving portion comprises one or more planar portions 133 and one or more sloped portions, which in this embodiment are declined portions 134.

The planar portion 133 and the declined portion 134 of the foot receiving portion are located at opposite end regions 136 of the foot receiving portion.

The declined portion 134 is located at a rear region of the foot receiving portion and the planar portion 133 of the foot receiving portion is located at a front region of the foot receiving portion. It will be understood that the planar portion 133 is described as such as it is planar when the apparatus 100 is in the first position 102*a*, with the declined portion 134 being named in a similar way.

In the embodiment shown in FIG. 6 and FIG. 7, at least a portion of the foot receiving portion has a curved profile through at least a part of the length thereof. The foot receiving portion comprises an arced section. The foot receiving portion has a substantially concave profile.

Due to the foot receiving portion of the embodiment shown in FIGS. 6 and 7, the apparatus 100 shown in FIGS. 6 and 7 is freestanding. Furthermore, the curvature of the foot receiving portion helps stabilise the apparatus 100 as the apparatus 100 rotates around the base of the foot during a lift. The rotation is minimal (only a few degrees), but this helps improve the grip of the user's shoe to the frame member 102.

In the embodiment shown in FIGS. 6 and 7, a first region of the foot receiving portion is arranged such that it is non-planar with respect to the second plane of the frame member 102 and a second region of the foot receiving portion is arranged such that it is substantially planar with respect to the second plane of the frame member 102. The first region is arranged to receive the heel of the user's foot, and the second region is arranged to receive the ball of the user's foot, although the first region and the second region may each receive either the heel or ball of the user's foot depending on the preference of the user.

FIG. 8*a* to FIG. 9*b* show an alternative embodiment of the apparatus 100 of FIGS. 6 and 7. In the embodiment shown in FIG. 8*a*, each gripping portion 116*a*, 116*b*, includes a first gripping member 138*a*, a second gripping member 138*b*, and a third gripping member 138*c* arranged to engage with a portion of the user's feet. The first gripping member 138*a* is located at a front region of each foot receiving portion 112*a*, 112*b* and the second gripping member 138*b* is located at a mid region of each foot receiving portion 112*a*, 112*b*. The first gripping members 138*a* are arranged to protrude from the first foot receiving portion 112*a*. The second gripping member 138*b* is located on the third support member 114, as in the embodiments shown in FIGS. 1 to 7.

Figure 8B:
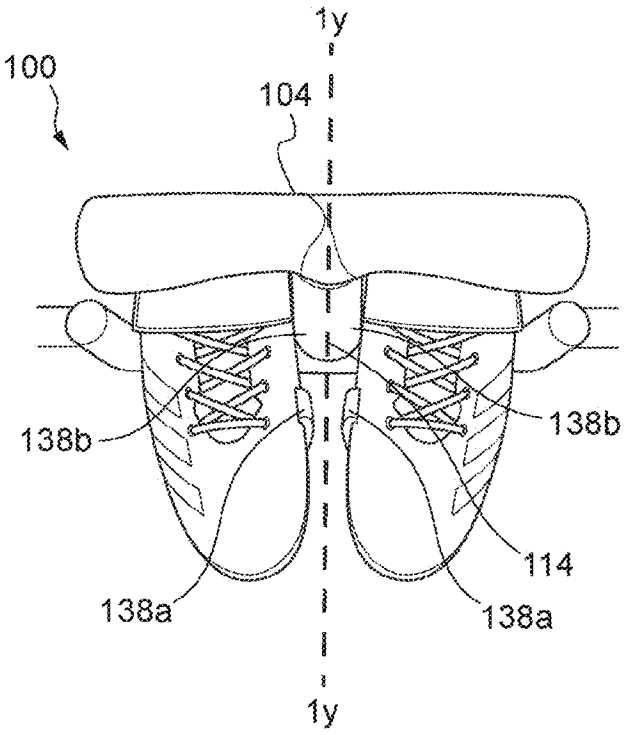
FIG. 8*b* shows the embodiment of FIG. 8*a* with the user's feet engaged therewith.
Figure 8A:
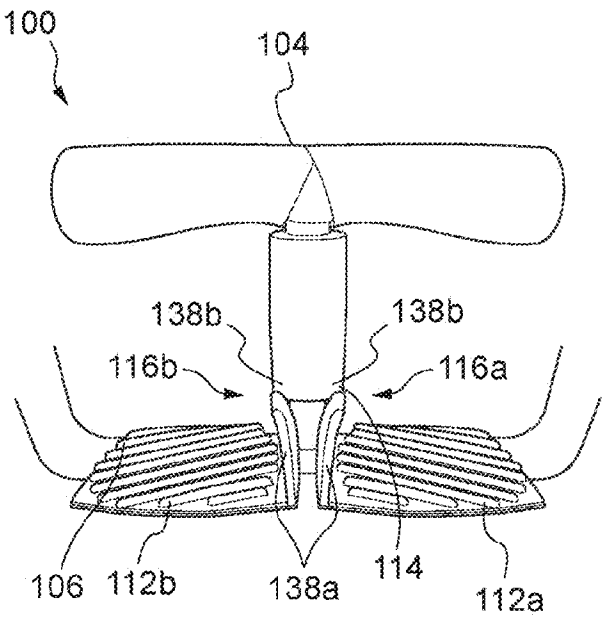
FIG. 8*a* shows an alternative embodiment of the leg exercise apparatus of FIG. 6 and FIG. 7.

FIG. 8*b* shows the embodiment of FIG. 8*a* in use with the user's feet engaged therewith. FIG. 8*b* shows a portion of user's foot engaging the first gripping member 138*a* and a portion of the user's foot engaging the second gripping member 138*b*. The user is thereby able to support the frame member 102 and prevent rotation around the vertical axis 1*y*.

Figure 9B:
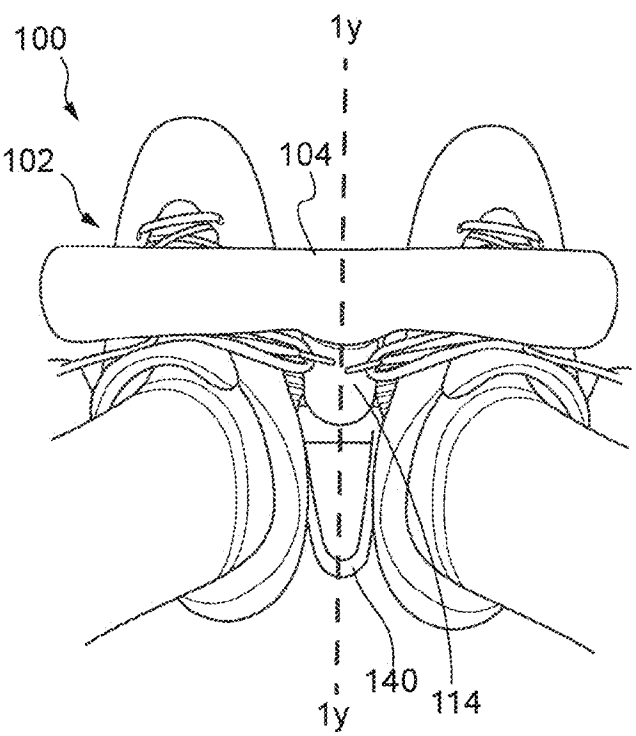
FIGS. 9*a* and 9*b* show rear views of the embodiment of FIG. 8*a*.
Figure 9A:
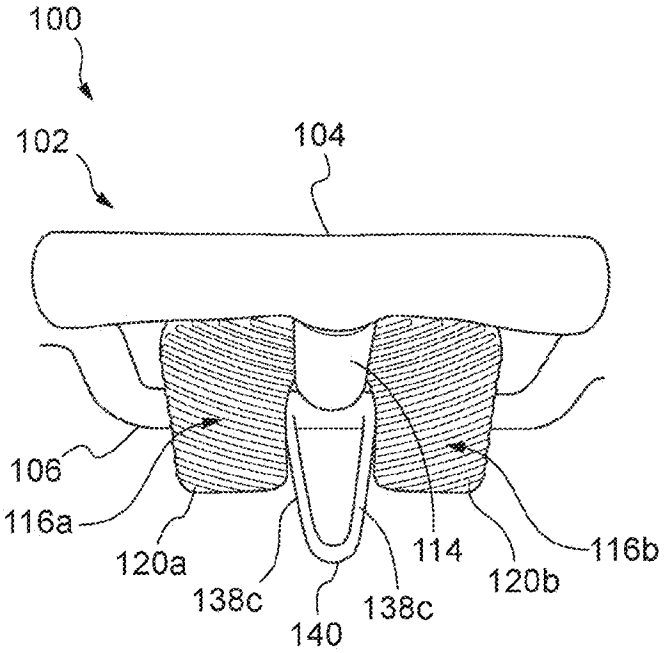

FIG. 9*a* and FIG. 9*b* show rear views of the apparatus 100, showing a connector 140 which is configured to receive or connect with a cable or the like. The connector 140 is integrally formed with the frame member 102. The connector 140 is a hoop member. The connector 140 is located at the second support member 106 and is adjacent to the third support member 114. The connector 140 is substantially parallel to the first foot receiving portion 120*a* and the second foot receiving portion 120*b*. The connector 140 is suitable for connecting the frame member 102 to a rope, a resistance band, a further connector, a cable machine, or the like.

The connector 140 is configured to engage with a rear portion or heel of the user's foot, and in this embodiment at least a portion of the connector 140 is defined by the third gripping members 138*c* of the first and second gripping portions 116*a*, 116*b*, as at least a portion of the connector 140 functions as a gripping member for the user's foot.

FIG. 9*b* shows the connector 140 which is configured to receive or connect with a cable, or the like, engaging with the rear portion of the user's foot. The user can, by connecting a cable to the connector 140, thereby alter the intensity of the exercise by increasing the resistance. Additionally, by gripping the connector 140 with their feet, the user is thereby able to support the frame member 102 and prevent rotation around the vertical axis 1*y*.

In the embodiment shown in FIGS. 8*a* to 9*b*, the apparatus 100 includes two gripping portions 116*a*, 116*b*, each gripping portion 116*a* 116*b*, comprising three gripping members 138*a*, 138*b*, 138*c* aligned substantially along the lateral axis 1*z* of the frame member 102.

The apparatus 100 is connectable to one or more further exercise apparatuses, such as a weight machine, or the like. The apparatus 100 is connectable to one or more resistance bands, one or more cable members, or the like. It is envisaged the further exercise apparatus may be configured such that it provides resistance to the movement of the leg exercise apparatus. For example, the further exercise apparatus may be a hamstring-curl machine, and the apparatus 100 could be used with that machine.

An example of how the apparatus 100 may be used will now be provided. First, the apparatus 100 may be positioned near to a weightlifting bench, and the user may sit or lie on the bench. The user will typically position themselves such that their chest is in contact with the bench, with the knees bent and their feet on or towards the ground. The user may place one foot on the first foot receiving surface 120*a* of the first foot receiving portion 112*a*, and place the other foot on the second foot receiving surface 120*b* of the second foot receiving portion 112*b* (shown in FIG. 4). Typically, the user will adduct their feet, to grip the gripping portions 116*a*, 116*b*, which increases the stability of the exercise.

With the user lying prone on the bench, with their feet on the first and second foot receiving surfaces 120*a*, 120*b*, the first and second leg engagement portions 108*a*, 108*b* may be spaced apart from the user's legs, or the first and second leg engagement portions 108*a*, 108*b* may be in contact with the user's legs, depending on the position adopted by the user. Next, as the user straightens the knees to move the frame member 102 further back from the body, and the user can pivot the frame member 102 with respect to the horizontal axis 1*x* of the frame member 102 by beginning to perform a hamstring curl (FIG. 3 shows this pivoting with one leg). This initial movement, performed while the apparatus 100 is on the ground, assists in getting the user's feet in a better position to curl the apparatus 100 off the ground. Next, the apparatus 100 is lifted from the ground by the motion of the user performing a hamstring curl. This exercise is similar to hamstring curls performed using a machine, with the main difference being the user can use a free standing piece of equipment and a bench to perform the exercise. The apparatus 100 can also be stowed using standard barbell storage equipment, such as stands and the like.

During the hamstring curl, the first and second leg engagement portions 108*a*, 108*b* will come into contact with the user's legs to support the apparatus 100 as it is lifted from the ground and curled. When the apparatus 100 is towards the end of the curl movement, the leg engagement portion in particular stabilises the apparatus 100 by engaging with the shins.

The resistance that is provided by the apparatus 100, particularly the first weight and second weight and the weight of the frame member 102, will exercise the hamstrings as the apparatus 100 is curled. However, it will be appreciated that the apparatus 100 can be used without the added weights, or can be connected to a further exercise apparatus.

Modifications and improvements may be made to the foregoing embodiments without departing from the scope of the present invention.

For example, although not shown here, the foot receiving portion could comprise one or more expandable or retractable portions operable to transition the foot receiving portion between a first foot receiving arrangement and a second foot receiving arrangement. The expandable or retractable portions could be manually operable portions. The foot receiving portion may be lockable in the first foot receiving arrangement and/or in the second foot receiving arrangement. This is advantageous as it means the foot receiving portion can be arranged to suit different foot sizes.

At least a portion of the second support member could comprise a knurled portion. The knurled portion can comprise sharp, deep, coarse or dulled knurling. The knurled portion can comprise sharp and deep knurling. At least a portion of the at least one foot receiving portion of the frame member could comprise a knurled portion. The knurled portion can comprise sharp, deep, coarse or dulled knurling. The knurled portion can comprise sharp and deep knurling.

The invention claimed is:

1. A leg exercise apparatus, the leg exercise apparatus comprising:

a frame member, the frame member including:

at least one foot receiving portion; and at least one leg engagement portion;

wherein the at least one leg engagement portion is spaced from the at least one foot receiving portion such that, in use, when a user's foot is located on the at least one foot receiving portion, the at least one leg engagement portion may contact a portion of the user's leg, wherein the frame member comprises a horizontal axis, a vertical axis and a lateral axis;

wherein the frame member comprises a plane defined by the horizontal axis of the frame member and the lateral axis of the frame member;

wherein the at least one foot receiving portion comprises one or more planar portions, for receiving a portion of the user's foot thereon; and wherein the at least one foot receiving portion is arranged on a plane that is angularly offset from the plane of the frame member about the horizontal axis of the frame member.

2. The leg exercise apparatus according to claim 1, wherein the frame member comprises a first support member and a second support member; and wherein the first support member and the second support member are spaced apart along one or more, optionally two or more, axes of the frame member.

3. The leg exercise apparatus according to claim 2, wherein the first support member and the second support member are spaced apart along the horizontal axis and/or the vertical axis of the frame member.

4. The leg exercise apparatus according to claim 2, wherein the frame member comprises a third support member and wherein the first support member and the second support member are connected by at least the third support member.

5. The leg exercise apparatus according to claim 4, wherein the third support member is substantially perpendicular to the first support member and/or the second support member.

6. The leg exercise apparatus according to claim 2, wherein the leg engagement portion is integrally formed with the first support member, and optionally wherein the foot receiving portion is integrally formed with at least a portion of the second support member.

7. The leg exercise apparatus according to claim 2, wherein the leg engagement portion comprises a first leg engagement portion and a second leg engagement portion spaced apart along at least one axis of the frame member, optionally the horizontal axis of the frame member.

8. The leg exercise apparatus according to claim 2, wherein the second support member is integrally formed with at least a portion of the at least one foot receiving portion.

9. The leg exercise apparatus according to claim 1, wherein the frame member comprises a gripping portion configured in use to permit the user to at least partially grip the frame member with the user's feet.

10. The leg exercise apparatus according to claim 9, wherein the gripping portion comprises one or more resilient portions.

11. The leg exercise apparatus according to claim 1, wherein at least a portion of the leg engagement portion is configured to be resilient.

12. The leg exercise apparatus according to claim 1, wherein the frame member comprises a first foot receiving portion and a second foot receiving portion spaced apart along at least one axis of the frame member.

13. The leg exercise apparatus according to claim 1, wherein the foot receiving portion is configured to be fixed relative to the leg engagement portion.

14. The leg exercise apparatus according to claim 1, wherein the frame member is configured to be pivotable, when in use, between a first position and a second position, and optionally wherein the first position is pivotably offset from the second position about at least one axis of the frame member.

15. The leg exercise apparatus according to claim 14, wherein the leg exercise apparatus is configured to permit the at least one leg engagement portion to pivot when in use between a first position and a second position.

16. The leg exercise apparatus according to claim 1, wherein the frame member comprises one or more weight receiving portions configured to be engageable with one or more weights.

17. The leg exercise apparatus according to claim 1, wherein components of the frame member are integrally formed.

18. The leg exercise apparatus according to claim 1, wherein the frame member is a substantially one-piece member.

* * * * *